US006235078B1

(12) United States Patent
Barkentin

(10) Patent No.: US 6,235,078 B1
(45) Date of Patent: May 22, 2001

(54) IRON ADDITIVE FOR ALLOYING NON-FERROUS ALLOYS

(75) Inventor: Karl-Axel Barkentin, Höganäs (SE)

(73) Assignee: Höganäs AB (SE)

( * ) Notice: Subject to any disclaimer, the term of this patent is extended or adjusted under 35 U.S.C. 154(b) by 0 days.

(21) Appl. No.: 09/315,010

(22) Filed: May 20, 1999

Related U.S. Application Data

(63) Continuation of application No. PCT/SE97/01943, filed on Nov. 20, 1997.

(30) Foreign Application Priority Data

Nov. 21, 1996 (SE) ..... 9604258

(51) Int. Cl.[7] ..... C22C 1/02
(52) U.S. Cl. ..... 75/436; 75/684; 75/316; 75/338

(58) Field of Search ..... 75/436, 684, 316, 75/338

(56) References Cited

U.S. PATENT DOCUMENTS

| | | | | |
|---|---|---|---|---|
| 2,986,460 | * | 5/1961 | Babcock et al. | 74/44 |
| 3,935,004 | * | 1/1976 | Faunce | 75/68 |
| 4,416,688 | * | 11/1983 | Greenwalt | 75/6 |
| 6,024,777 | | 2/2000 | Houser et al. | 75/304 |
| 6,048,382 | * | 4/2000 | Greenwalt | 75/436 |

* cited by examiner

*Primary Examiner*—Roy V. King
*Assistant Examiner*—Nicole Coy
(74) *Attorney, Agent, or Firm*—Burns, Doane, Swecker & Mathis, L.L.P.

(57) ABSTRACT

The present invention concerns additives for non-ferrous, liquid metals. The additives consist of compacted bodies of essentially pure iron particles.

17 Claims, 2 Drawing Sheets

IRON ADDITIVE FOR ALLOYING NON-FERROUS ALLOYS

Figure 1:
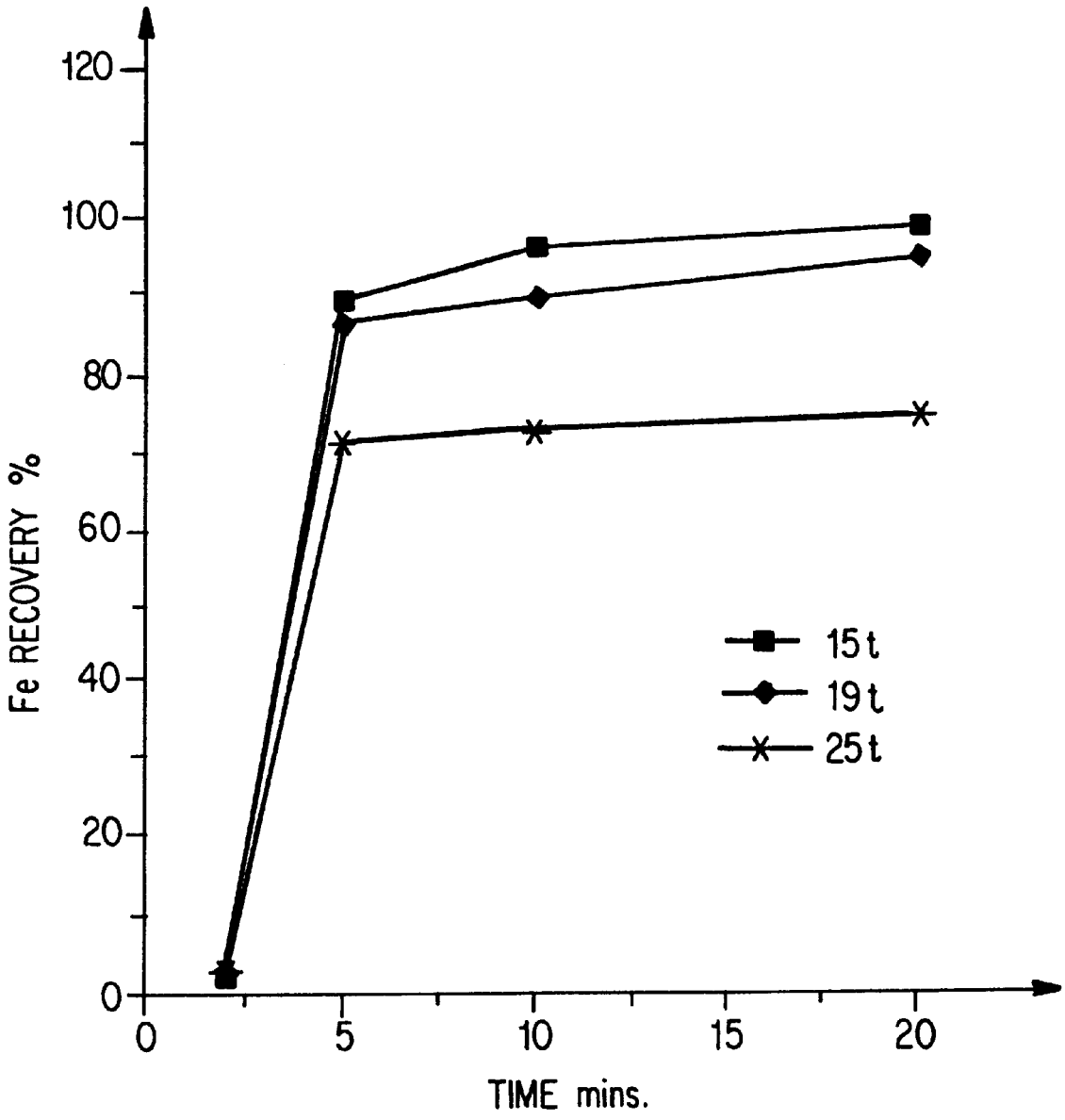

This is a continuation of International Application No. PCT/SE97/01943, filed Nov. 20, 1997, that designates the United States of America and which claims priority from Swedish Application No. 9604258-5, filed Nov. 21, 1996.

Iron is generally considered to be an undesired impurity in aluminum. However, small contents of iron (0.15–1.8% by weight) in aluminum influence the mechanical properties of aluminum and make it easier to roll thin aluminum sheets. Aluminum with an increased iron content can also be used in profiles, since the iron improves the extrusion properties.

Aluminium produced by electrolysis contains small amounts of iron originating from the anodes of the electrolytic cell. This iron content, not sufficient for producing aluminium suitable for foils and profiles, and hence iron has to be added.

In the manufacture of iron-containing aluminium the addition of iron can be made in form of iron scrap or lumps of an Al—Fe master alloy containing about 5–30% by weight of iron. Iron powder and iron-powder-based tablets are also used because of the advantages they offer in the form of shorter dissolution time.

The addition of pulverulent materials can be made by injection together with a carrying gas through a lance. The powder is injected either into the ladle, the holding furnace or the casting furnace. The temperature of the aluminium melt is kept in the range of 720–760° C., which is the normal alloying temperature irrespective of the applied alloying method. Higher temperature can be used, but this does not result in a decrease of the dissolution time of the iron powder.

A very important property of the iron powder to be used in the injection process is its particle size. Particles which are small will follow the gas bubbles to the dross on the melt surface and they can also cause dust-forming problems in various stages of the process. Particles being too large will not dissolve fast enough.

It is also important that the surface of the particles is substantially free of an oxide layer which, if present, could deteriorate wetting of the particles by the molten aluminium and thus block or slow down their dissolution. Additionally and as indicated above, the injection process requires special equipment.

When iron powder tablets are used, they are simply thrown into the aluminium melt, through which they sink and dissolve. Some users manufacture the tablets themselves, but there are also commercially available tablets. So-called alloying tablets contain 75–80% of the alloying metal which besides Fe can be Mn, Cr, Cu, Ti, Pb, Ni or Zn. The balance is pure aluminium plus suitable fluxes to accelerate dissolution and to protect the alloying metal as it dissolves. The tablets are made to such an accurate weight and composition that they do not have to be weighed before being used to guarantee the correct dosage.

It has now been found that the previous methods based on the addition of iron-based powders or tablets can be considerably improved, if the iron is added to the metal melt in the form of solid bodies of compacted iron particles consisting of essentially pure iron. In this context the term "non-ferrous metal" includes metals selected from the group consisting of aluminium, copper and copper-based alloys. By using an additive consisting of bodies of compacted iron particles according to the invention, the dissolution rate of iron in the non-ferrous metal melt can be faster. From this follows that the productivity can be increased due to the shorter periods of time at the melting temperature. The use of the compacted iron bodies thus also implies that less energy is consumed. Furthermore, due to the purity of the compacted iron bodies, fewer inclusions are formed and therefore less subsequent purification treatment is needed, which simplifies the manufacture of the alloyed metal.

The advantages obtained by using the compacted bodies according to the present invention are unexpected and quite remarkable in view of the teaching in U.S. Pat. No. 3,935,004 which discloses that compacted bodies of alloying agents, which have been tested for the addition to molten aluminium, were not effective. Specifically this patent discloses that compacted alloying additives for alloying metals to aluminium should contain a fluxing agent as a critical ingredient. This known additive should preferably also contain binding materials. The compacted bodies used according to the present invention are quite the contrary and should not include any fluxing or binding agents.

The new compacted iron bodies can be manufactured from a atomised iron powder or from a sponge iron powder, such as AHC100.29 or M40, M80, M100, M120, W100.25 W40.24 and A40S, all available from Höganäs AB, Sweden. In contrast to the alloying additives disclosed in WO94/17217 no melting step is involved when the compacted bodies according to the present invention are prepared from the solid atomised or sponge iron powders.

The density of the compacted bodies should be sufficiently high so that the bodies do not disintegrate during handling and transportation and so that the bodies do not float on the surface of the metal bath. Thus the densities should be at least 4, preferably at least 5 g/cm$^3$. The preferred density interval is between 5.1 and 6.7 g/cm$^3$. To this end the powders are compacted in e.g. a conventional mill at a pressure of at least 200 MPa and at most 500 MPa, the preferred interval being between 250 and 400 MPa. The green strength of the compacted body should preferably be at least 5 MPa, most preferably at least 10 MPa. The influence of the compacting pressure on the solubility or recovery rate can be seen in FIG. 1.

A suitable thickness of the compacted body obtained from the milling operation might vary between 0.5 and 4 mm. The body is subsequently torn to a suitable size. The tearing can be performed in a conventional mill to a size of at least 50 mm$^2$, preferably at least 100 mm$^2$. It is of course also possible to add the compacted bodies in the form of larger pieces or strips or any other suitable form.

Important factors are also the oxygen and carbon contents of the compacted iron bodies. According to one embodiment of the invention which is especially suitable for use instead of the currently used iron powder tablets, the oxygen content should be between 0.3 and 2%, and preferably the oxygen content varies between 0.5 and 1.5% by weight of the compacted iron bodies. The carbon content should be between 0.02 and 0.75%, and preferably the carbon content should vary between 0.05 and 0.5% by weight of the compacted iron bodies. In this case the iron powder is suitably a non-annealed sponge iron powder.

In an alternative embodiment of the invention, where it is critical that the amount of inclusions is kept low, the amount of oxygen and carbon should be even lower. When in this alternative sponge iron is used, the amount of oxygen could vary between 0.1 and 1.5 and preferably between 0.15 and 1.0% by weight. The carbon content should vary between 0.0001 and 0.20 and preferably between 0.002 and 0.15% by weight. The most preferred material for obtaining low amounts of inclusions is an atomised iron powder having an oxygen content between 0.03 and 1.5, preferably between 0.1 and 1.0% by weight. The carbon content should vary between 0.0001 and 0.02, preferably between 0.002 and 0.15% by weight. These low-oxygen, low-carbon compacted bodies are particularly interesting for high quality products.

Figure 2:
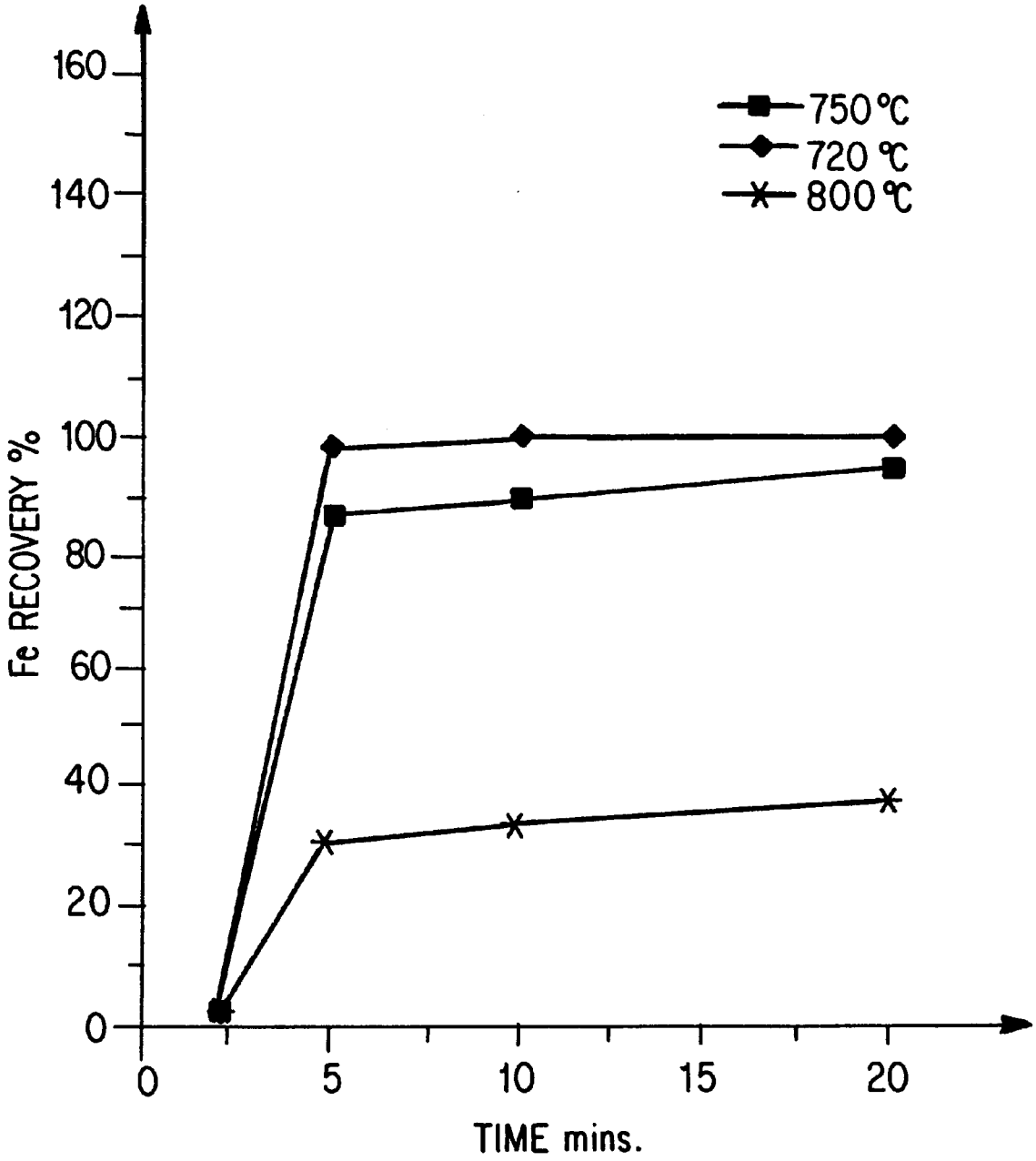

When the non-ferrous metal is aluminium it is preferred that the temperature of the metal melt is between 680° C. and 780° C., and most preferred between 700° and 750° C. FIG. 2 discloses the solubility rates at different temperatures for bodies compacted at 19 tonnes.

The first step in the practical application of the compacted iron bodies or flakes is to calculate the necessary quantity of iron to reach the specified Fe content of the Al—Fe material. In this calculation the Fe-yield is set at 100% of added iron. The Fe material is then added to the melting furnace either in loose form, and in that case it is spread over the entire surface of the aluminium melt. Alternatively it is added packed in bags containing a predetermined amount of flakes. After the addition, a stirring operation is started and continued until the iron is completely dissolved An investigation concerning the correlation between iron powder properties and the rate of dissolution in molten aluminium has been carried out. From this investigation the following can be reported.

Six iron powder products according to Table 1 below were included in the investigation. The samples 1–3 consisted of the loose uncompacted powders not within the scope of the present invention and the samples 4–6 are examples of compacted bodies according to the present invention.

TABLE 1

| Sample No. | Powder | Pressure tonne | Density | % $O_{tot}$ | % C | $Fe_{tot}$ |
|---|---|---|---|---|---|---|
| 1 | M 80 | — | — | 0.70 | 0.21 | 98.5 |
| 2 | W 100.25 | — | — | 0.49 | 0.003 | 99.5 |
| 3 | AHC 100.29 | — | — | 0.10 | <0.01 | 99.5 |
| 4 | M 80 | 19 | 5.5 | 0.75 | 0.20 | 98.5 |
| 5 | W 100.25 | 17 | 5.1 | 0.4 | 0.005 | 99.5 |
| 6 | AHC 100.29 | 19 | 6.4 | 0.10 | <0.01 | 99.5 |
| Fe80 STD ALTAB* | | | | | | |

*Commercially used tablet available from London & Scandinavian Metallurgical Co Limited, London, and including flux agents in addition to iron Each type of iron powder was compacted to small cylinders measuring 4 mm in diameter and 7 mm in height. The pressure used was just sufficient to keep the compacts from falling apart. The mass of a cylinder was 400–450 mg and the amount of aluminium in each test was 70 g, so that the final iron content after complete dissolution of the iron cylinder was roughly 0.7%.

The iron additive according to the invention was used as a single flaky particle of suitable size.

The tests were carried out in a reaction chamber having a diameter of 50 mm, which was heated in a furnace. An aluminia crucible with the dimensions 40 mm in diameter and 60 mm in height was filled with pieces of solid, pure (99.7% Al) aluminium. The crucible was placed in a holder that could be moved vertically in the reaction chamber. The iron compact was placed in an aluminia holder and introduced into the reaction chamber and suspended above the aluminium in the crucible by thin steel suspension wires from an electrobalance, by means of which weight changes could be recorded with very high sensibility (detection limit 1 $\mu$g).

The test was carried out in a very pure argon atmosphere, and no oxidation of the iron samples or the aluminium could be detected during the heating sequence. The temperature in the reaction chamber was controlled by a thermocouple.

When the desired reaction temperature (in most tests 720° C.) was reached, the alumina crucible with the aluminium melt was pushed upwards so that the iron sample was submerged in the melt. The weight changes of the test sample was registered as intervals of 5 seconds during the dissolution studies.

The results of the dissolution test have been recorded in the following table 2 showing the weight loss of the iron sample as a percentage of its initial weight as a function of time. This percentage is designated "recovery".

TABLE 2

| | Recovery % at 750° C. | | |
|---|---|---|---|
| Sample No. | after 5 min. | after 10 min. | after 15 min. |
| 1 | 65 | 82 | 87 |
| 2 | 70 | 90 | 92 |
| 3 | 65 | 75 | 75 |
| 4 | 93 | 100 | 100 |
| 5 | 100 | 100 | 100 |
| 6 | 95 | 98 | 100 |
| Fe80 STD ALTAB* | 75 | 75 | 80 |

*Commercially used tablet available from London & Scandinavian Metallurgical Co Limited, London, and including flux agents in addition to iron.

Decreasing the temperature of the aluminium melt from the normally applied 720 to 700° C. increases the dissolution time and reduces the recovery substantially, whereas an increase to 750° C. has a marginal effect only.

The compacted iron bodies mentioned above consist of about 2 mm thick flakes with a size of roughly 15×15 mm.

The following table 3 discloses the amount of inclusions.

TABLE 3

| Sample No. | Total inclusion content $mm^2/kg$ |
|---|---|
| 4 | 14.3 |
| 5 | 2.88 |
| 6 | 1.08 |
| 25 FeAl waffle** | 0.17 |
| Fe80 STD ALTAB* | 16.53 |

*Commercially used tablet available from London & Scandinavian Metallurgical Co Limited, London, and including flux agents in addition to iron.
**Product prepared according to WO94/17217

The small amounts of inclusions in the samples 5 and 6 according to the present invention clearly indicate that these products could be an interesting alternative to the 25 FeAl Waffle, the manufacture of which is more complicated than the manufacture of the compacted bodies according to the present invention.

Although described with particular reference to the addition of iron flakes to liquid aluminium, it is obvious that the iron flakes according to the invention can be added also to other non-ferrous melted metals such as copper and copper alloys.

What is claimed is:

1. A method of alloying non-ferrous, liquid metals, comprising adding an additive to a melt of a non-ferrous metal, the additive consisting of compacted bodies of essentially pure particles of atomised or sponge iron wherein the compacted bodies have a density of at least 4 $g/cm^3$ and thickness of about 0.5 to about 4 mm.

2. The method according to claim 1, characterized in that the compacted body does not include any auxiliary agents such as fluxing agents or binding agents.

3. The method according to claim 1, characterized in that the particles are sponge iron particles including between 0.3 and 2.0% by weight of oxygen, and between 0.02 and 0.75% by weight of carbon.

4. The method according to claim 1, characterized in that the particles are sponge iron particles including between 0.1 and 1.5% by weight of oxygen, and between 0.0001 and 0.2% by weight of carbon.

5. The method according to claim 1, characterized in that the iron particles are atomised iron particles including between 0.03 and 1.5% by weight of oxygen, and between 0.0001 and 0.20% by weight of carbon.

6. The method according to claim 1, charaterized in that the compacted body has the form of a flake.

7. The method according to claim 1, characterized in that it is added to a liquid metal selected from the group consisting of Al, Cu, Cu based alloys.

8. The method according to claim 1, characterized in that the compacted body is a flake having a cross-sectional area of at least 50 $mm^2$.

9. The method according to claim 1, characterized in that the compacted body has a green strength of at least 5 MPa.

10. The method according to claim 1, characterized in that the compacted body has a density of at least 5 $g/cm^3$.

11. The method according to claim 1, characterized in that the compacted body does not include any auxiliary agents including fluxing agents or binding agents.

12. The method according to claim 1, characterized in that the particles are sponge iron particles including between 0.5 and 1.5% by weight of oxygen, and between 0.05 and 0.5% by weight of carbon.

13. The method according to claim 1, characterized in that the particles are sponge iron particles including between 0.15 and 1.0% by weight of oxygen, and between 0.002 and 0.15% by weight of carbon.

14. The method according to claim 1, characterized in that the iron particles are atomised iron particles including between 0.1 and 1.0% by weight of oxygen, and between 0.002 and 0.15% by weight of carbon.

15. The method according to claim 1, characterized in that the compacted body is a flake having a cross-sectional area of at least 100 $mm^2$.

16. The method according to claim 1, characterized in that the non-ferrous metal comprises an aluminum based alloy.

17. The method according to claim 1, characterized in that the melt is blended for a time sufficient for complete dissolution of the compacted bodies.

* * * * *